United States Patent [19]

Rudell et al.

[11] Patent Number: 4,982,959

[45] Date of Patent: Jan. 8, 1991

[54] WATER SPRINKLER MAT GAME

[75] Inventors: Elliot Rudell, 6556 Sattes Dr., Rancho Palos Verdes, Calif. 90274; George Foster, Signal Hill, Calif.

[73] Assignee: Elliot Rudell, Torrance, Calif.

[21] Appl. No.: 406,419

[22] Filed: Sep. 11, 1989

[51] Int. Cl.[5] ..... A63F 9/00

[52] U.S. Cl. ..... 273/1 GE; 273/1 GF; 272/1 B

[58] Field of Search ..... 273/1 G, 1 GE, 1 GF, 273/243, 1 L; 272/1 B, 56.5

[56] References Cited

U.S. PATENT DOCUMENTS

| | | | |
|---|---|---|---|
| 3,484,106 | 12/1969 | Foley et al. | 273/1 GF |
| 3,486,177 | 12/1969 | Marshack | 273/1 B X |
| 4,078,792 | 3/1978 | Arato | 272/1 B |

FOREIGN PATENT DOCUMENTS

| | | | |
|---|---|---|---|
| 255117 | 5/1963 | Australia | 272/56.5 R |

OTHER PUBLICATIONS

Washington Post 10-21-1983, p. B-8, Nancy.

Sears Christmas Book 1968, 9-1968, p. 479, Animal Twister.

Wham-O Mfg. Co., Advertising circular 3-1965, Slip 'N Slide.

*Primary Examiner*—Paul E. Shapiro

*Attorney, Agent, or Firm*—Plante, Strauss, Vanderburgh & Connors

[57] ABSTRACT

An outdoor game for a plurality of players who on a novel game mat having a flat playing surface which bears a plurality of position-identifying indicia. The mat also has a water distributor and a plurality of water spray orifices which are located at preselected positions on the surface of the game mat and connected to the water distributor whereby application of water under pressure to the water distributor forms a plurality of vertical water sprays about the playing surface. In the game, players call out particular commands to each other which are spontaneous or can be selected from randomly stacked game cards and which require the responding player to touch the location of the particular indicium on the mat, and to remain in contact with all previously identified indicia during the remainder of the play. The objective of the play is to disqualify players by causing an opposing player to become so tangled up as to fall, or to render performance of a command without falling impossible. During the play, the numerous orifices in the surface of the mat create vertical fountains of water which soak the players and increase the difficulty of play by imparting a slippery or slick condition to the playing surface.

9 Claims, 5 Drawing Sheets

20
68
70
18
10

20
18
70

20
70
18

WATER SPRINKLER MAT GAME

BACKGROUND OF THE INVENTION

1. Field of Invention

This invention relates to a game and to a mat used in the game and in particular to an outdoor game with a mat that sprays water on the players.

2. Description of Prior Art

Action games wherein people actively participate with their bodies are well known. The most popular game is called TWISTER marketed by Milton Bradley Company. In this game one or two players are required to touch unnumbered but colored squares on a vinyl mat. Another action game is described in U.S. Pat. No. 4,684,127 in which players are tethered together with removable straps and attempt to obey commands from a remote player who attempts to tangle the players up and thereby force the release of one or more of the tethers.

Various physical action games involving liquids or water are rare. Latex balloons have been filled with water and thrown at objects and other participants in a common outdoor summer pastime for children. Water polo and other games played in a swimming pool are also common. A recent U.S. Pat. No. 4,813,680 describes a game in which a player wears a hat or helmet which contains water and the water is released when a particular valve member is removed. Another recently issued patent, U. S. , discloses a game in which a water-filled ball having a timed release valve is tossed between the players with the object of avoiding becoming wet when the water is released.

There are several other outdoor water activity toys which offer unstructured or non-rule and non-competitive play. A water slide toy is marketed by Wham-0 Manufacturing called SLIP N SLIDE. This toy has a long vinyl mat that is wetted with a garden hose which distributes the water through holes in the mat. Children run up to and slide down the wet, slick surface. A competitive variation of this product is Marchon's SURF SLIDER wherein children run and slide along a long vinyl mat that is wet by a sprinkler located beside the mat. A number of serious safety concerns have recently been voiced by the Consumer Products Safety Commission on the long vinyl mat water toys as they present an injury hazard to the children. This hazard is accentuated by the necessity to anchor the mats to the lawn using metal or plastic anchors which also provide potentially dangerous obstructions to children.

Finally, Wham-O markets a novelty sprinkler called Fun Fountain which has a base in the shape of a clown's head. The base is attached to a garden hose. A stream of water is directed upwardly through the clown's head, raising the head several feet in the air and cascades down on the children as they run or dance around the sprinkler.

OBJECTIVES OF THE INVENTION

It is an object of this invention to provide a water spray game involving competitive-rules play.

It is also an object of this invention to provide a game mat that provides a playing surface which generates a plurality of water fountain sprays.

It is a further object of this invention to provide a new competitive, rule-structured game.

Variations and related objects will be apparent from the following description of the invention.

BRIEF STATEMENT OF THE INVENTION

This invention is an outdoor game involving a plurality of players. The players stand on a novel game mat that is particularly designed for a rule-structured competitive play. The game mat has a flat playing surface which bears a plurality of position identifying indicia. The mat also has a water distributor and a plurality of water spray orifices which are located at preselected positions on the surface of the game mat and connected to the water distributor whereby application of water under pressure to the water distributor forms a plurality of vertical water sprays about the playing surface.

In the game, players call out particular commands to each other. These commands can be spontaneous or can be selected from randomly stacked game cards, each of which has a particular indicium command. The objective of the play is to disqualify players by causing an opposing player to become so tangled up as to fall, or to render performance of a command without falling impossible. The commands are indicia-identifying commands which require the responding player to touch the location of the particular indicium on the mat with the player's feet or hands, and to remain in contact with all identified indicia through the remainder of the play. During this play, the numerous orifices in the surface of the mat create vertical fountains of water which soak the players and increase the difficulty of play by imparting a slippery or slick condition to the playing surface.

BRIEF DESCRIPTION OF THE DRAWINGS

The invention will now be described with reference to the FIGURES of which.

DESCRIPTION OF PREFERRED EMBODIMENTS

Figure 1:
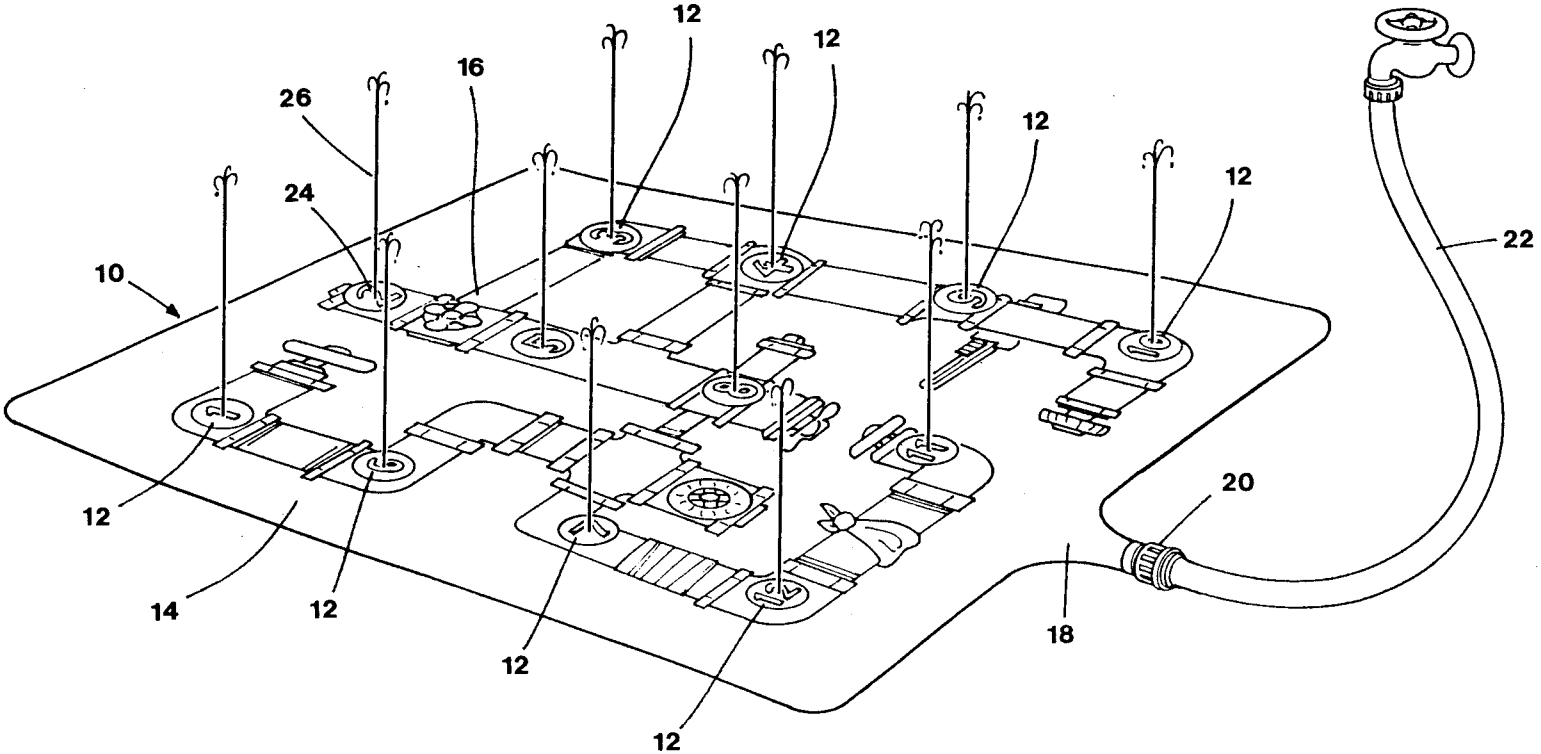
FIG. 1 illustrates a game mat of the invention attached to a conventional garden hose.

Referring now to FIG. 1, the game mat 10 of the invention is illustrated. The game mat 10 is a flat planar member which bears a plurality of indicia 12 on its upper, playing surface 14. The indicia are location identifying indicia which can be letters or numbers. Additionally, the game mat 10 can have a decorative or graphic theme on its playing surface, such as the imaginary plumbing assembly 16 which is illustrated in FIG. 1. Preferably, a plurality of location-identifying indicia 12 are used; FIG. 1 shows twelve such indicium, bearing arabic numbers 1 through 12.

The game mat 10 also includes an integral water distributor (not shown in FIG. 1) which underlies the playing surface 14. In FIG. 1, the distributor is incorporated within the playing mat 10 in a manner hereinafter described. This water distributor extends coextensively the length and width of the playing surface 14 and is connected to an inlet nozzle 18 which bears a conventional hose bib 20 for attachment of a garden hose 22 and the like. A plurality of small diameter orifices 24 are located about the playing surface 14, each communicating through the playing surface and into the water distributor, thereby forming a plurality of water spray orifices which, upon application of water pressure to the water distributor, will form a plurality of vertical water fountain sprays 26. In the illustrated embodiment, a single spray orifice 24 is associated with each of the position indicating indicia 12.

Figure 2:
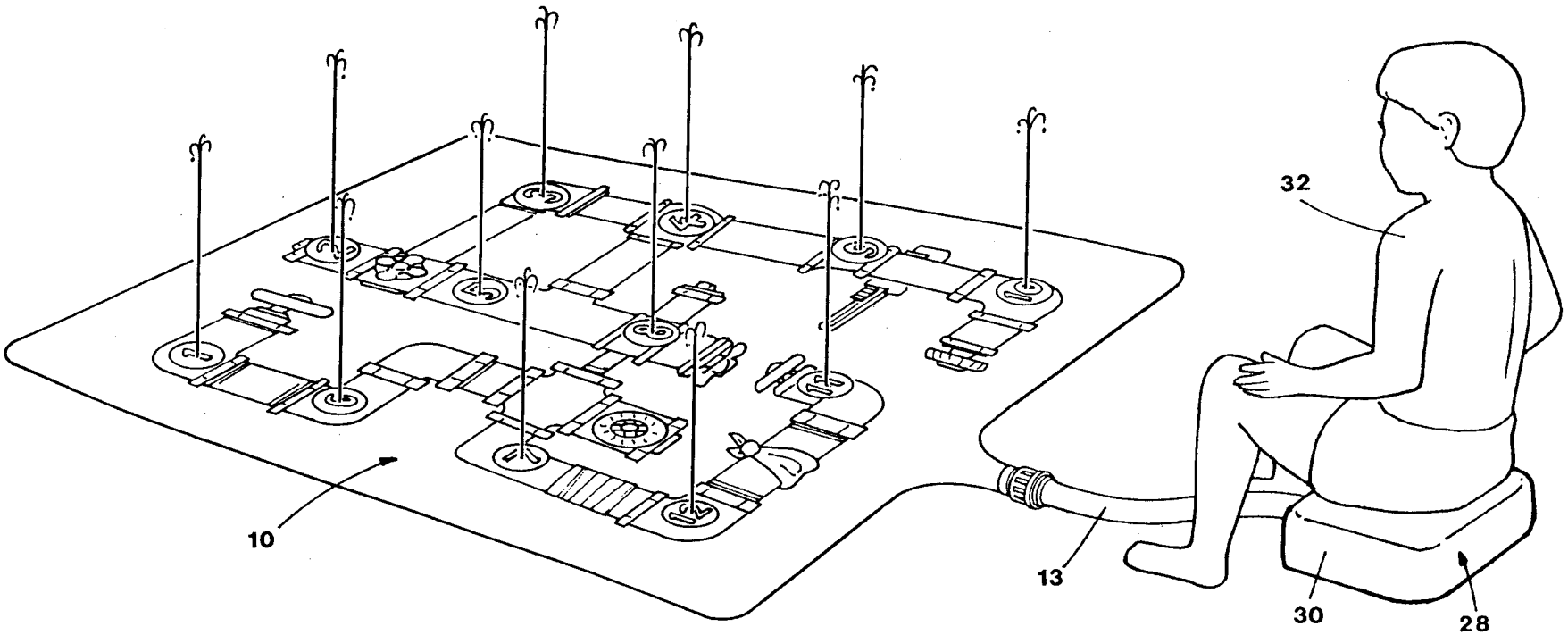
FIG. 2 illustrates the game mat of the invention attached to an alternative water reservoir and seat.

In some applications, the play area may not be located within the reach of a garden hose and, for those applications it is desirable to provide a self-contained water pressurization system. FIG. 2 illustrates such a system in which the game mat 10, previously described with reference to FIG. 1, is attached to a hose 13 that leads to a separate water reservoir 28. The water reservoir has a bulbous container or bag 30 which is formed of a flexible or elastomeric material and which has a sufficient volume, e.g. from 1 to about 5 gallons, to provide sufficient water for a prolonged game activity. The water is pressurized in this application by the weight of a player 32 who can rest his weight on the water reservoir 28 either by standing or sitting thereon as illustrated.

Figure 3:
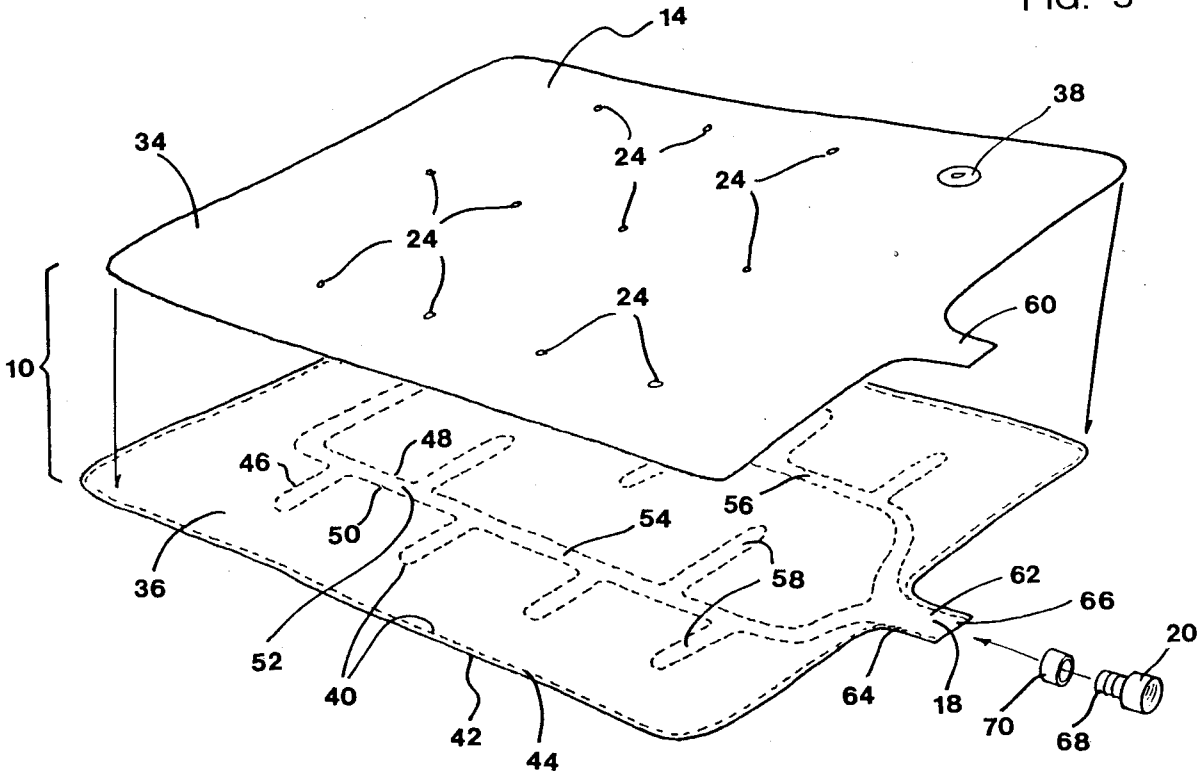
FIG. 3 is an exploded perspective view illustrating the assembly of the game mat of the invention.

Referring now to FIG. 3, the construction of the game mat 10 of the invention will be described. As there illustrated, the game mat 10 is formed by a lamination of an upper sheet 34 and a lower sheet 36 of flexible plastic. These plastic sheets can have a film thickness from 0.001 to about 0.1 inch, preferably from about 0.02 to about 0.08 inch and are formed of a suitable thermoplastic material such as a vinyl plastic, e.g., polyvinyl chloride. The upper plastic sheet 34 has the aforementioned plurality of orifices 24 which are located at preselected locations distributed across the entire playing surface 14. Each of the orifices 24 can be formed in a rigid plastic disc 38, typically a plastic disc having a thickness of about 0.1 to about 0.2 inch and of a sufficient diameter to provide and a horizontal orientation of the disc and thereby insuring that the water spray 26 formed by the orifice 24 will be substantially vertical. The vinyl disc 38 can be heat sealed or otherwise bonded to the surface of the plastic sheet 34 which constitutes the upper playing surface 14 of the mat 10.

The upper sheet 34 and lower sheet 36 of the vinyl mat 14 are bonded together in a plurality of seams 40 which are indicated on the lower portion of FIG. 3 as broken lines. Preferably, the upper and lower sheets are bonded about their peripheries 42 in continuous, peripheral seams such as 44. This bonding can be by heat sealing, ultrasonic bonding, or by chemical bonding. Additionally, the sheets 34 and 36 are bonded with a plurality of inner seams 46 that extend laterally and longitudinally of the assembly. Preferably, the seams 46 are arranged as pairs of parallel seams 48 and 50 which thereby define, between them, a channel or passageway 52 for water. As illustrated, two longitudinal channels 54 and 56, and a plurality of laterally extending cross channels 58 are located across the surface of the mat.

The mat 10 is provided with an inlet nozzle 18 which is formed by tabs 60 and 62 of the upper and lower sheets. These tabs are also bonded with a peripheral seam 64 to provide a nozzle which is unseamed at its outer-most end 66. A conventional hose bib 20 with a sleeve connector 68 is inserted into the resulting nozzle formed in the mat 10 and is secured thereto by a sliding, lock sleeve 70.

Figure 4:
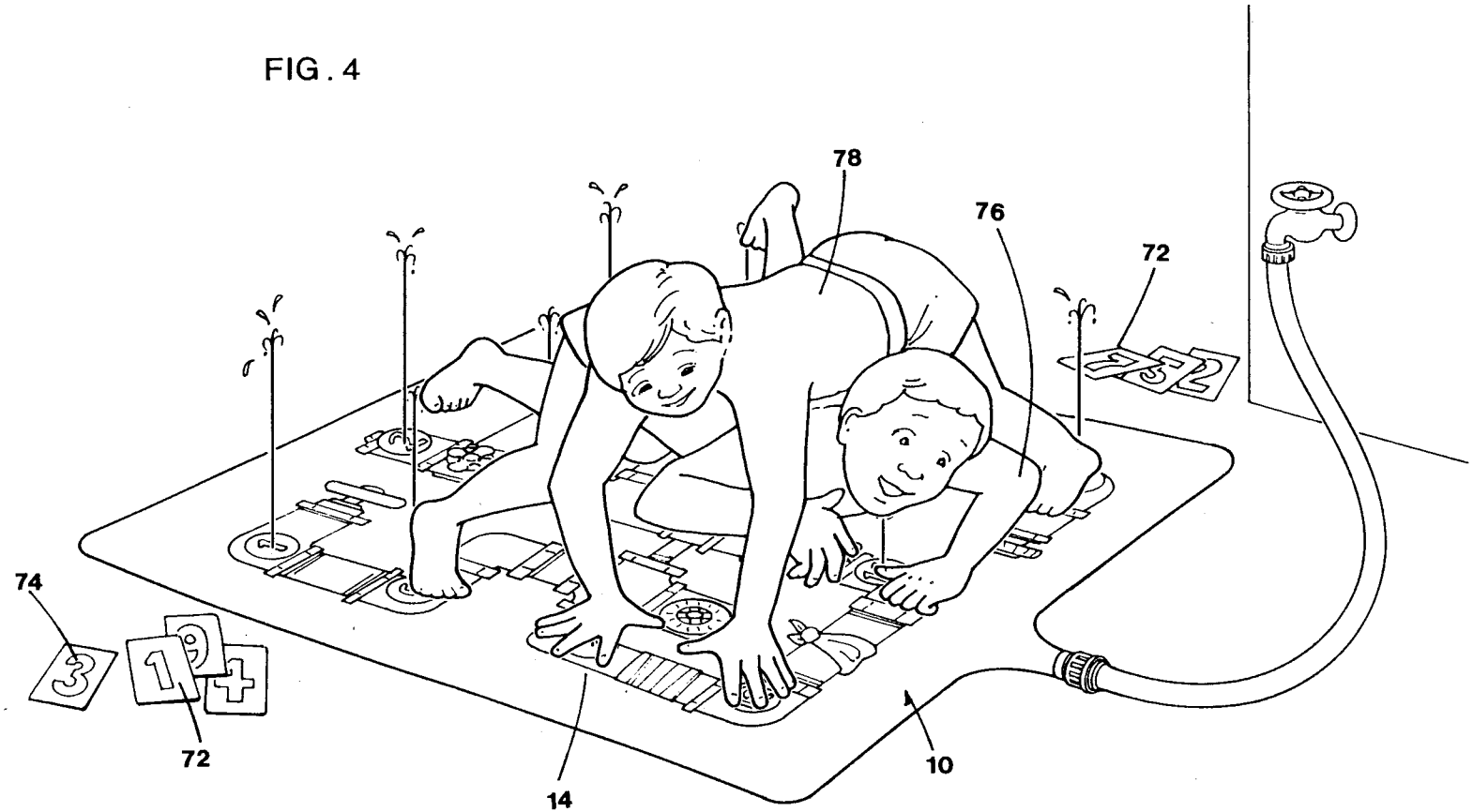
FIG. 4 illustrates a typical game scenario.

FIG. 4 illustrates a typical scene during the play activity on the mat 10. The game can be played with a plurality of numbered cards 72, each of which bears a single indicium 74 of the plurality of indicia. The cards are distributed to the players in a random fashion and a player selects a card which identifies a position on the playing surface which that player or an opponent player must cover with his body. As illustrated in FIG. 4, two players 76 and 78 are participating in the game and each of these players has received commands such as the group of commands 3, 1, 9 and 2 shown on the cards 72 at the lower left of the playing surface 14, while the other player has received the numbers 5, 8 and 7 shown on the cards 72 at the opposite corner of the playing surface 14.

In this game, each of the players must cover the identified positions such as the positions which are covered by the feet of player 76 and the numbers which are covered by the hands of player 78. In the progress of the game, the cards 72 are dealt out randomly to the two, three or four players. Each of the players stands on a different corner of the mat and commands another player, such as the one on his left, to touch with a specified hand or foot one of the numbered areas on the game mat corresponding to one of that player's cards. The cards are visible to all of the players because they are placed face up beside the player's corner of the mat as shown. As the play continues, each player has to bend and twist to obey the commands of his opponent players until one or more of the players either falls or is unable to reach and touch a designated position of the playing surface. The play is made more difficult because of the constant upward fountains or jets of water which spray from the numbered areas on the mat, resulting in wetting of all the players. The players will also try to avoid the direct water sprays as they obey the commands, thereby adding to the difficulty in executing commands. Additionally, the playing surface of the game mat becomes quite slippery and wet, further increasing the difficulty required to maintain contact with selected areas of the playing surface. In the play, a player is disqualified when any part of the player's body except a hand or foot touches the mat. The last player remaining in the game is the winner.

The game can also be played without use of the cards or can be continued after all the cards have been used. In such play, the players can sequentially call out any number on the mat which is currently unoccupied by any player and require the player next in order to touch that location with a hand or foot.

Figures 5, 5A, 5B:
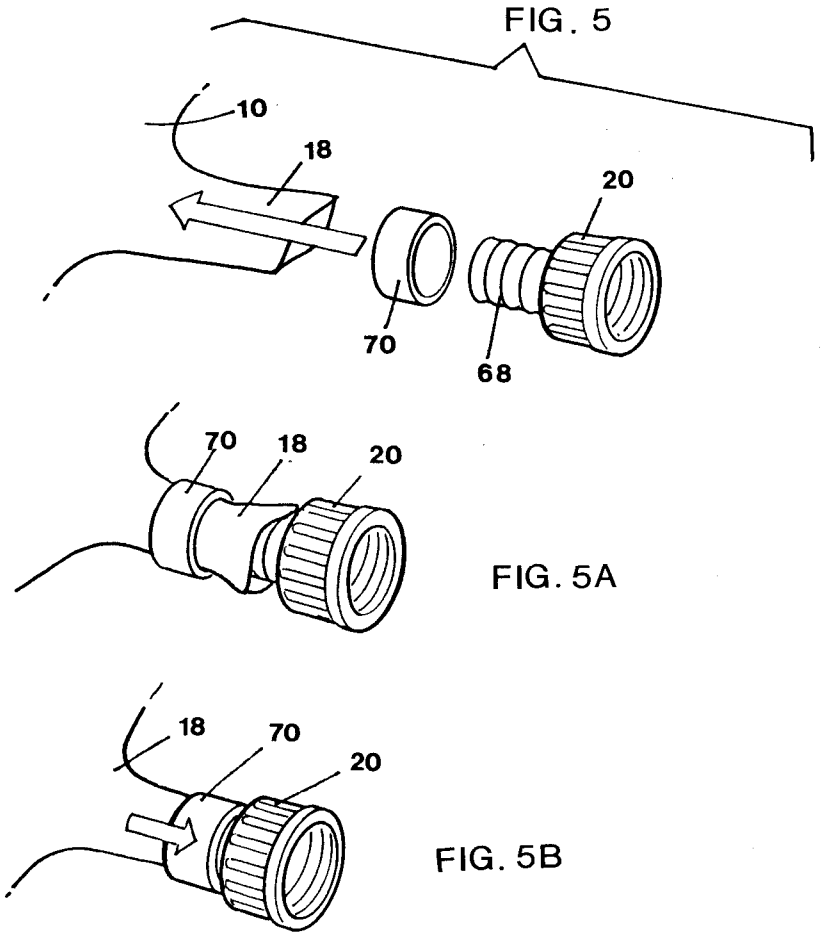
FIG. 5 illustrates the steps in assembly of the hose connector for the game mat of the invention.

Referring now to FIG. 5, there is illustrated the attachment of a hose bib connector to the game mat. As previously mentioned, the mat 10 is provided with a nozzle 18 that is open to provide an inlet port. A conventional garden hose bib 20 having a tubular sleeve connector 68, preferably with a plurality of annular grooves, is inserted into the nozzle 18 of the game mat 14. A locking sleeve 70 is slipped over the neck of the sleeve connector 68 in the manner illustrated in FIG. 5A and firmly seated in place as illustrated in FIG. 5B.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A game mat comprising:

a. a flat sheet providing a playing surface;

b. a plurality of position-indicating indicia located at preselected positions about the upper surface of said flat sheet;

c. an enclosed body immediately beneath said flat sheet containing a fluid distributor comprising a plurality of interconnected fluid flow passageways extending longitudinally and laterally coextensive with the length and width of said flat sheet;

d. an inlet port to said enclosed body with attachment means to attach a source of water under pressure to said inlet port; and e. a plurality of apertures extending through said flat sheet and opening into said fluid distributor of said body, said apertures being of small diameter, sufficient to form a discharge spray of liquid upon the application of a liquid under pressure to said inlet port.

2. The game mat of claim 1 wherein said attachment means comprises a hose connector.

3. The game mat of claim 1 wherein said mat is formed of a pair of flat sheets of plastic which are bonded together about their peripheral edges, thereby forming said body.

4. The game mat of claim 1 wherein said mat is formed of a pair of flat sheets of plastic which are bonded together along a plurality of parallel seams on a preselected pattern to form said fluid distributor.

5. The game mat of claim 1 wherein said each of said position-indicating indicia are located immediately adjacent a respective one of said apertures.

6. The game mat of claim 1 including diagrammatic indicia on the top surface of said sheet.

7. The game mat of claim 1 in combination with a water reservoir comprising a flexible, bulbous container having an enclosed internal chamber with a single outlet port and including a hose extending between said single outlet port and said port of said mat body.

8. A game method comprising:

a. attaching a flat mat having an upper playing surface bearing position-indicating indicia, and internal water flow passageways with a plurality of spray apertures therein located at preselected positions about the surface of said mat, and a single inlet port to a source of water under pressure, thereby producing a plurality of water sprays discharging upwardly from said playing surface;

b. selecting and sequentially giving commands which require selected players to touch and to remain in bodily contact with randomly selected indicia of said position-indicating indicia; and c. disqualifying a player who is unable to successfully carry out a command without releasing contact with a previously identified indicia, and continuing said giving of commands until only one of the players remains in contact with all of the indicia identified to such player.

9. The method of claim 1 wherein said selecting and sequentially giving of commands comprises the steps of randomly selecting one of a plurality of game cards, each of which contains an indicia of said plurality of indicia.

* * * * *